US005765885A

United States Patent [19]

Netto

[11] Patent Number: 5,765,885

[45] Date of Patent: Jun. 16, 1998

[54] SECURITY SEAL

[75] Inventor: Eduardo De Lima Castro Netto, Rio de Janeiro, Brazil

[73] Assignee: ELC Produtos de Seguranca E Comercio LTDA., Rio de Janeiro, Brazil

[21] Appl. No.: 403,812

[22] PCT Filed: Sep. 14, 1993

[86] PCT No.: PCT/BR93/00033

§ 371 Date: Mar. 14, 1995

§ 102(e) Date: Mar. 14, 1995

[87] PCT Pub. No.: WO94/06701

PCT Pub. Date: Mar. 31, 1994

[30] Foreign Application Priority Data

Sep. 15, 1992 [BR] Brazil ..... 9203596

[51] Int. Cl.[6] ..... B65D 55/06

[52] U.S. Cl. ..... 292/318; 292/307 A

[58] Field of Search ..... 292/318, 317, 292/319, 321, 322, 325, 307 A, DIG. 38

[56] References Cited

U.S. PATENT DOCUMENTS

| | | | |
|---|---|---|---|
| 3,556,575 | 1/1971 | Farkas | 292/307 R |
| 4,306,745 | 12/1981 | Wenk | 292/318 |
| 4,347,648 | 9/1982 | Dekkers | 24/16 PB |
| 4,501,049 | 2/1985 | Adamson . | |
| 4,506,415 | 3/1985 | Swift | 24/16 PB |
| 4,580,319 | 4/1986 | Paradis | 24/16 PB |
| 5,031,943 | 7/1991 | Scott et al. | 292/307 R |
| 5,125,700 | 6/1992 | Fattori et al. | 292/318 |
| 5,337,503 | 8/1994 | Goby | 40/665 |
| 5,441,316 | 8/1995 | Georgopoulos | 292/320 |
| 5,524,945 | 6/1996 | Georgopoulos et al. | 292/307 A |
| 5,542,724 | 8/1996 | Neto | 292/317 |

FOREIGN PATENT DOCUMENTS

| | | | |
|---|---|---|---|
| 398562 | 11/1990 | European Pat. Off. . | |
| 438 277 | 7/1991 | European Pat. Off. . | |
| 438277 | 7/1991 | European Pat. Off. | G09F 3/14 |
| 1468568 | 12/1966 | France . | |
| 1468568 | 2/1967 | France . | |
| 2220979 | 1/1990 | United Kingdom . | |

*Primary Examiner*—Steven N. Meyers
*Assistant Examiner*—Donald J. Lecher
*Attorney, Agent, or Firm*—Beveridge, DeGrandi, Weilacher & Young

[57] ABSTRACT

A tie-type security seal having a seal body (1) with internal locking teeth (5) in a tunnel (2) and an elongate element (11) having a series of sealing formations (14) therealong. The free end (13) of the elongate element (11) may be passed through the tunnel (2) so that the sealing formations (14) successively cooperate with the teeth (5) on tightening the loop so formed. According to the invention, a locking accessory (9) integral with the seal body (1) is formed with a through opening (15) having a shape substantially identical to the cross section of the elongate element (11) and at least one flexible edge part (16) to adjust itself to the differences in the said cross section in the regions of the regions of the sealing formations. The accessory (9) is foldable with respect to the seal body (1) so that the through opening (15) is superimposed on the open outlet (4) of the tunnel (2) in the seal body. When the seal is closed, the accessory (9) together with the body (cross section) of the elongate element (11) totally blocks the outlet of the tunnel (2), preventing attempts at violation.

9 Claims, 2 Drawing Sheets

SECURITY SEAL

BACKGROUND OF THE INVENTION

The present invention refers to a security seal and more particularly to a seal of the type known as "pull-tight". This type of seal has a seal body defining a tunnel having first and second open ends and being formed internally with at least one locking tooth. An element to be locked in the tunnel comprises a flexible elongate element having a free end, the elongate element having a series of sealing formations along its length so that, on insertion of the free end through the first end of the tunnel and on it being pulled through the second end of the tunnel, the sealing portions cooperate with the sealing tooth in a manner similar to a ratchet. This prevents withdrawal of the elongate element through the first end of the tunnel.

Security seals of the aforementioned type are widely used—often as ties—spite of the reduced degree of security they offer. It will therefore be understood that the introduction of a needle or the like into that side of the tunnel from which the free end of the elongate element protrudes permits—sometimes with great facility—the unlocking of the inner locking teeth from the formations or teeth on the elongate element, thus permitting the slow, but progressive withdrawal of the elongate element from the seal body.

Furthermore, the formations or teeth on the elongate element are relatively aggressive to the touch and this is prejudicial to those whose work involves the application of large daily amounts of this type of seal.

A seal of this type is known that has a considerably improved degree of security due to the specific configuration of the flexible elongate part, whereby the sealing formations comprise stepped depressions along the elongate element the surface of which adjacent the depressions is substantially smooth and without sharp corners or edges. This results in a smoother—less aggressive—touch for the hands of the user.

A seal with this improvement is disclosed in Brazilian patent application PI 8906110 of Dec. 01, 1989, the degree of security being further improved due to the fact that, at the second end of the tunnel in the seal body, there is a pair of flexible tabs aligned with the locking teeth, which serve together with the section of the elongate part to close the second end of the tunnel, this making it difficult to introduce needles or the like during an unauthorized attempt to open the seal. Forming the seal body with the inner locking teeth and also with the protecting tabs, however, makes the manufacture of the seal more difficult with the necessity to use more complex moulds.

The object of this invention is to provide a seal of the above type, that has the same improved degree of security as the seal illustrated in Brazilian patent application PI 8906110, but which is much simpler to manufacture.

SUMMARY

According to the present invention, a security seal of the above defined type is characterised by comprising a locking accessory integral with the seal body and formed with a through opening of a shape substantially identical to the cross section of the elongate element and with at least a part of its edge flexible to adjust itself to the differences in such cross section in the regions of the sealing formations, the accessory being foldable with respect to the seal body so that the through opening may be superimposed over the second open end of the tunnel in the seal body.

The result of this improvement is that, in use, the second end of the tunnel in the seal body is substantially closed not only by the elongate element itself, but also by the accessory that is moulded in a region of the mold away from that corresponding to the more complex seal body.

Preferably, the flexible edge part of the through opening comprises a tab which, in the folded position with the opening superimposed on the second end of the tunnel, is aligned with the locking tooth of the latter.

In the presently preferred embodiment of the invention, there are two locking teeth and two flexible edge parts of the through opening in the form of tabs which, in the folded position superimposed on the second end of the tunnel, are respectively aligned with the two locking teeth.

In the same preferred embodiment, the sealing formations on the elongate element comprise two parallel series of stepped depressions formed along opposite sides of the elongate element, the surfaces between the two series being curved convexly.

The accessory may comprise a plate having a first side edge connected to a base of the said seal body so that it may be folded over the plate to assume the configuration with the second open end of the tunnel superimposed on the through opening, the plate having a second side edge, opposite the first side edge and integral with a second end of the said elongate element.

BRIEF DESCRIPTION OF THE DRAWING

The invention will be better understood from the following description, given by way of example, with reference to the accompanying drawings, in which.

DESCRIPTION OF THE PREFERRED EMBODIMENT

Figure 1:
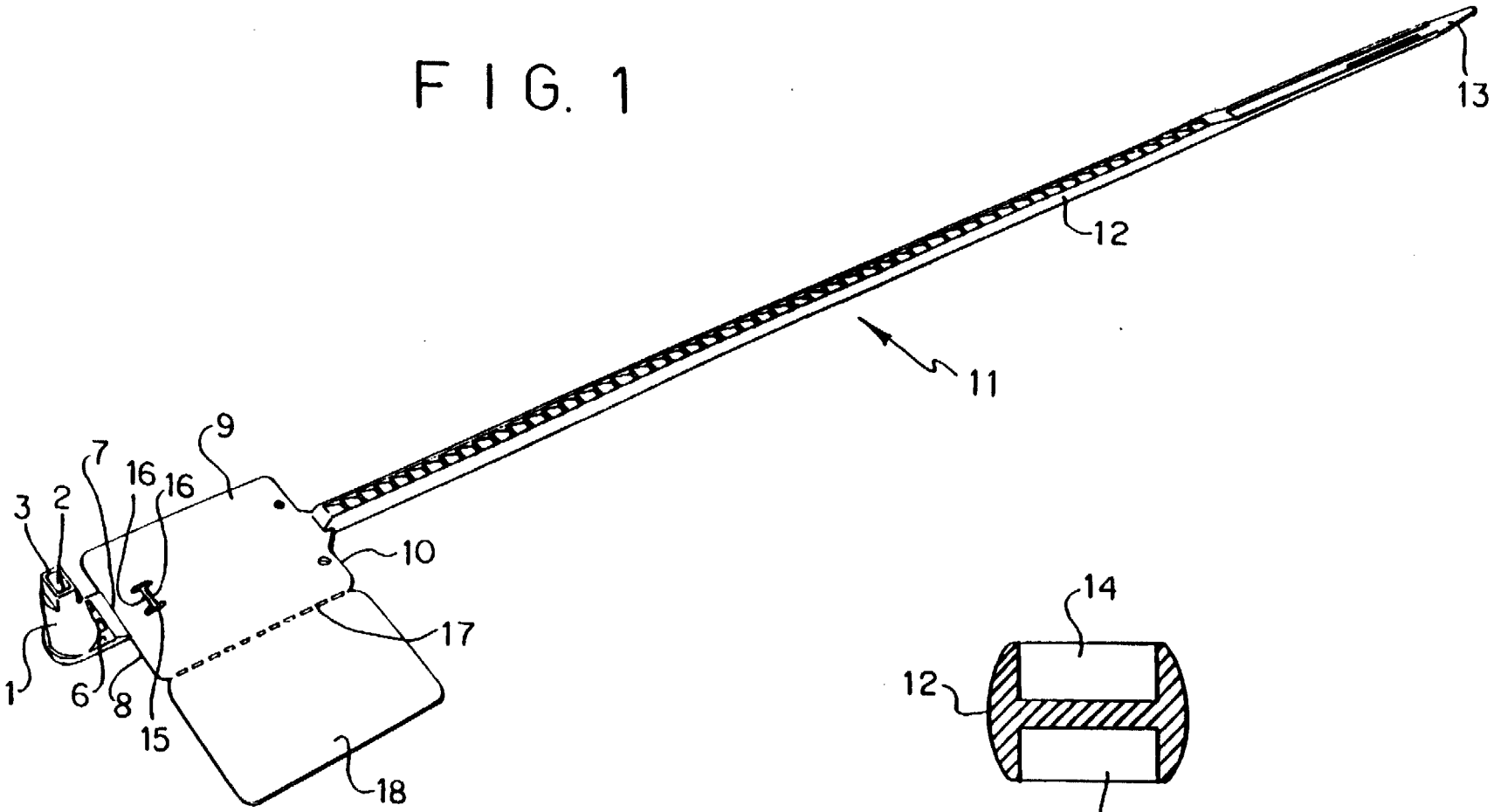
FIG. 1 is an upper perspective view of a security seal manufactured in accordance with the presently preferred embodiment of the present invention.

The accompanying drawings show, as an example of an embodiment of the present invention, a "pull-tight" type security seal incorporating the new inventive concept. Thus, the seal comprises a seal body 1 formed with a tunnel 2 having a first open end 3 and a second open end 4. Within tunnel 2, there is a pair of locking teeth 5.

Seal body 1 is formed on a base 6 that is connected, by means of a plastic hinge (line of weakening) 7, to a first side edge 8 of a rectangular plate 9. It is this plate 9 that —according to the invention—serves as a sealing accessory, as will be explained later.

An element to be locked in the form of an elongate flexible element 11, having a main extension 12 and a free end 13, extends from a side edge 10 opposite edge 8 of plate 9. Along the main extension 12, there are sealing formations comprising two series of stepped depressions, the higher parts forming teeth 14. The rest of the cross section of the elongate element 11 (see FIG. 5), that is to say, between the two series of teeth/depressions 14, is substantially in the form of quadrants of a circle having curved outer surfaces. Teeth 14 serve, in use, to cooperate with locking teeth 5 in tunnel 2.

Figure 5:
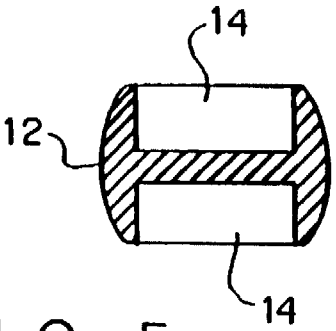
FIG. 5 is a section along line V—V of FIG. 2.

Respecting the cross section of elongate element 11, shown in FIG. 5, the plate or accessory 9 is formed with a through opening 15 of a shape substantially identical to that of the cross section of the main extension 12 of elongate element 11, having two flexible tabs 16 that correspond to the hollow spaces between teeth 14.

Another side edge 17 of accessory or plate 9 is connected by means of weakening bridges to another plate 18 of an identical size which may easily be separated. In use, the two plates 9 and 18 will carry identical numbers—preferably both conventional numbering and bar codes—so that, when an article sealed with the seal is despatched, a "true" copy (plate 18) of plate 9 may be retained by the sender.

Figure 3:
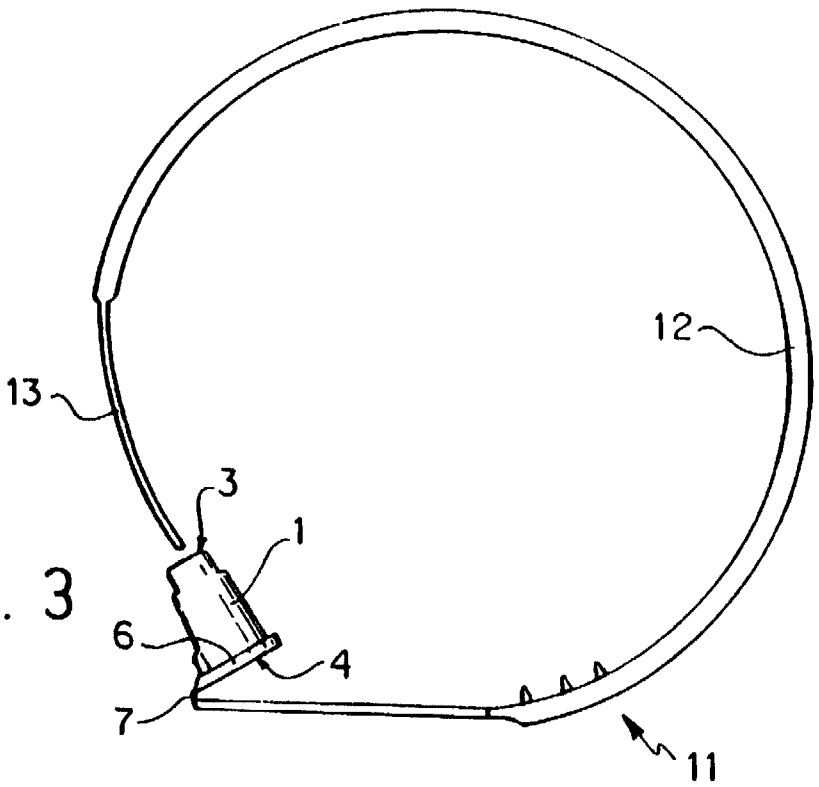
FIG. 3 is a side view of the same seal just before closure.

FIG. 3 shows the seal (side view) shortly before closure. It will thus be seen that seal body 1 is folded about line 7 so that its base 6 becomes superimposed on plate 9 and, more precisely, with the second open end 4 facing downwardly in register with the through opening 15 in plate 9. The first (entry) opening 3 face upwards and flexible elongate element 11 is curved upwardly and its free end 13 is then folded down in preparation for penetration into open end 3.

Figure 4:
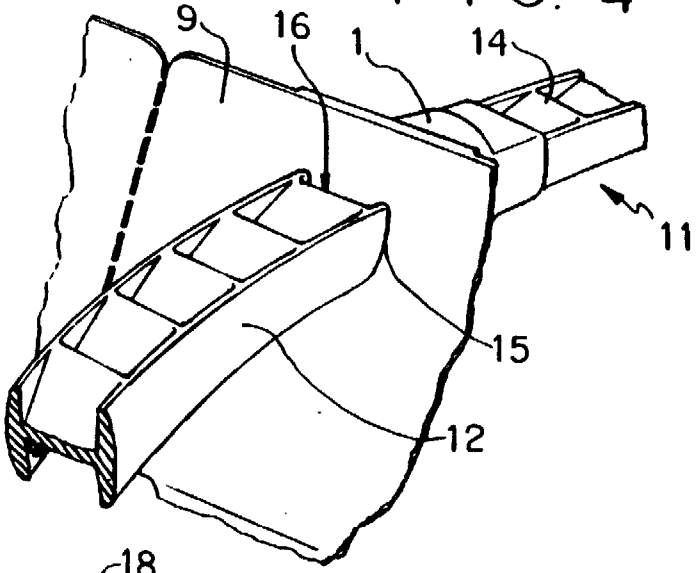
FIG. 4 is a perspective view of a detail, showing the cooperation between the elongate closure element of the seal and the locking accessory of the invention, when the seal is in its closed configuration.
Figure 2:
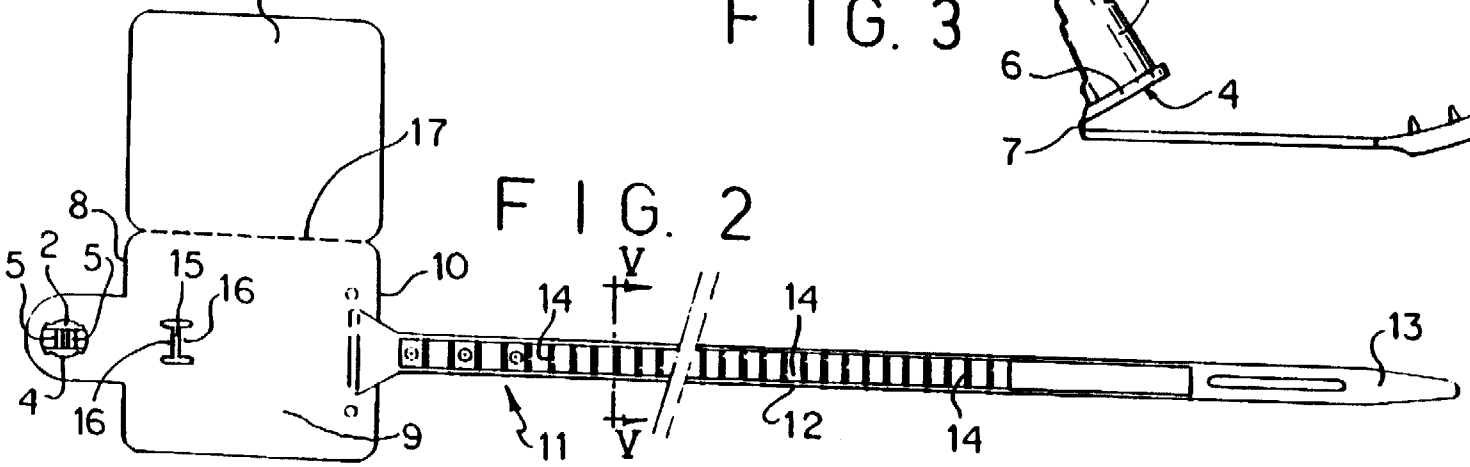
FIG. 2 is a bottom plan view of the security seal shown in FIG. 1.

At the instant between those illustrated in FIGS. 3 and 4, the tip of free end 13 is introduced into end 3 of tunnel 2 and, on appearing out of the other side of the tunnel after passing through opening 15 in the accessory or plate 9, it is manually pulled outwardly. End 13 is then pulled until the loop formed by the elongate element is of the desired size. As end 13 is pulled, teeth 14 in the main extension of the elongate element 11 pass successively past inner teeth 5 in the tunnel 2, teeth 5 yielding elastically each time a pair of teeth 14 passes and then returning to their original configuration in which they impede the withdrawal of the elongate element 11. It will be understood that the cooperation between the teeth is ratchet-like, it always being possible to tighten the loop formed by the elongate element, but never to loosen it.

As already mentioned, a seal of this type does not generally have a high degree of security due to the possibility of a potential violator introducing a blade or needle through the second end 4 of tunnel 2 in an attempt successively to liberate teeth 14 on the elongate element and consequently to remove the latter from the seal.

According to the present invention, however, such a method of violation becomes almost impossible due to the fact that the free end 13 of elongate element 11 passes through opening 15 in plate 9, tabs 16 entering elastically into the spaces between teeth 14. Thus, plate 9 with tabs 16, together with the cross section of the elongate element 11 itself, totally block the end 4 of tunnel 2.

The fact that the two tabs 16—which act almost as if they were teeth—are part of the flat plate 9 and not of a relatively complex structure such as seal body 1 with internal teeth 6, greatly simplifies and cheapens the cost of the injection mould used in the manufacture of the seal.

It will be understood that, although only one seal embodying the present invention has been described and illustrated in detail, many "pull-tight" seals of the most various shapes and employing a variety of different specific forms of sealing already exist on the market. The basic concept of this invention may be applied to any one of such seals and will always simplify manufacture as well as increase the degree of security of the seal. This concept may be reused as the idea of providing a formation that blocks the outlet end of the seal body without forming part of such body, but rather becomes fixed over the outlet end only when the seal is closed. There are various manners of practicing this idea and all should be considered as covered by the present invention the scope of which should therefore be limited only by the terms of the following claims.

I claim:

1. Security seal comprising a seal body defining a tunnel having first and second open ends and being formed internally with at least one locking tooth, and a flexible elongate element having a free end, the elongate element having a series of sealing formations along its length so that, on insertion of the free end through the said first end of the tunnel and on it being pulled through the second end of the tunnel, the sealing formations cooperate with the said sealing tooth in a manner similar to a ratchet, preventing withdrawal of the elongate element from the first end of the tunnel, a locking accessory integral with the seal body and formed with a through opening of a shape substantially identical to the cross section of the elongate element, said through opening having an inner edge, adjustment means for adjusting the cross section of said through opening to adapt to differences in the cross section of the elongate element in regions of said sealing formations, said inner edge of said through opening having a flexible tab which is said adjustment means, the accessory being foldable with respect to the seal body so that said through opening in the accessory becomes superimposed on the second open end of the said tunnel in the seal body.

2. Security seal according to claim 1, wherein said seal body has a base, said accessory including a plate having a first side edge connected to said base of said seal body so that it may be folded over the plate to assume a configuration with said second open end superimposed on the through opening in the plate, said elongate element having a second end which is opposite said free end, the plate having a second side edge opposite to said first side edge and integral with said second end of said elongate element.

3. Security seal according to claim 1, wherein, when said accessory is folded with the opening superimposed on said second end, said tab is aligned with the locking tooth in said tunnel.

4. Security seal according to claim 3, wherein said seal body has a base, said accessory including a plate having a first side edge connected to said base of said seal body so that it may be folded over the plate to assume a configuration with said second open end superimposed on the through opening in the plate, said elongate element having a second end which is opposite said free end, the plate having a second side edge opposite to said first side edge and integral with said second end of said elongate element.

5. Security seal according to claim 1, wherein the sealing formations comprise stepped depressions on the flexible elongate element.

6. Security seal according to claim 5, wherein there are two parallel series of said stepped depressions formed along opposite sides of the elongate element, and convexly curved outer surfaces between the two parallel series of stepped depressions.

7. Security seal according to claim 1, wherein there are two locking teeth in said tunnel and two flexible edge parts of the through opening in the form of tabs which, when folded with the through opening superimposed on said second end of the tunnel, are respectively aligned with the two locking teeth.

8. Security seal according to claim, wherein the sealing formations comprise stepped depressions on the flexible elongate element.

9. Security seal according to claim 8, wherein there are two parallel series of said stepped depressions formed along opposite sides of the elongate element, and convexly curved outer surfaces between the two parallel series of stepped depressions.

* * * * *